United States Patent [19]

Schwartz et al.

[11] 4,083,476

[45] Apr. 11, 1978

[54] SNAP DEVICE FOR MANUALLY ACTUATED LIQUID-ATOMIZING PUMPS

[75] Inventors: Hans Schwartz, Warthausen-Oberhofen; Helmut Franz, Mettenberg, Biberach, both of Germany

[73] Assignee: Boehringer Ingelheim GmbH, Ingelheim am Rhein, Germany

[21] Appl. No.: 746,700

[22] Filed: Dec. 2, 1976

Related U.S. Application Data

[63] Continuation-in-part of Ser. No. 711,318, Aug. 3, 1976, abandoned, which is a continuation of Ser. No. 522,228, Nov. 8, 1974, abandoned.

[30] Foreign Application Priority Data

Nov. 30, 1973 Germany ..... 7342638

[51] Int. Cl.[2] ..... B05B 11/00

[52] U.S. Cl. ..... 222/321; 222/498; 239/333

[58] Field of Search ..... 222/498, 499, 321, 320, 222/477; 239/333, 350

[56] References Cited

U.S. PATENT DOCUMENTS

| | | | |
|---|---|---|---|
| 3,396,874 | 5/1967 | Malone | 222/321 X |
| 3,779,464 | 12/1973 | Malone | 222/321 X |
| 3,825,159 | 7/1974 | Lauuwe | 222/499 X |

*Primary Examiner*—Robert B. Reeves
*Assistant Examiner*—Frederick R. Handren
*Attorney, Agent, or Firm*—Hammond & Littell

[57] ABSTRACT

An improved manually actuated liquid-atomizing pump assembly for non-pressurized pharmaceutical atomizers comprising a pump actuator unit and a pump unit, which causes a spray of substantially the same particle size spectrum to be discharged from the atomizer nozzle with each actuation of the pump; the improvement resides in a resilient mechanical resistance interposed between the manual pump actuator and the pump, where the resilient resistance requires a very definite amount of force to be overcome.

3 Claims, 3 Drawing Figures

SNAP DEVICE FOR MANUALLY ACTUATED LIQUID-ATOMIZING PUMPS

Figure 1:
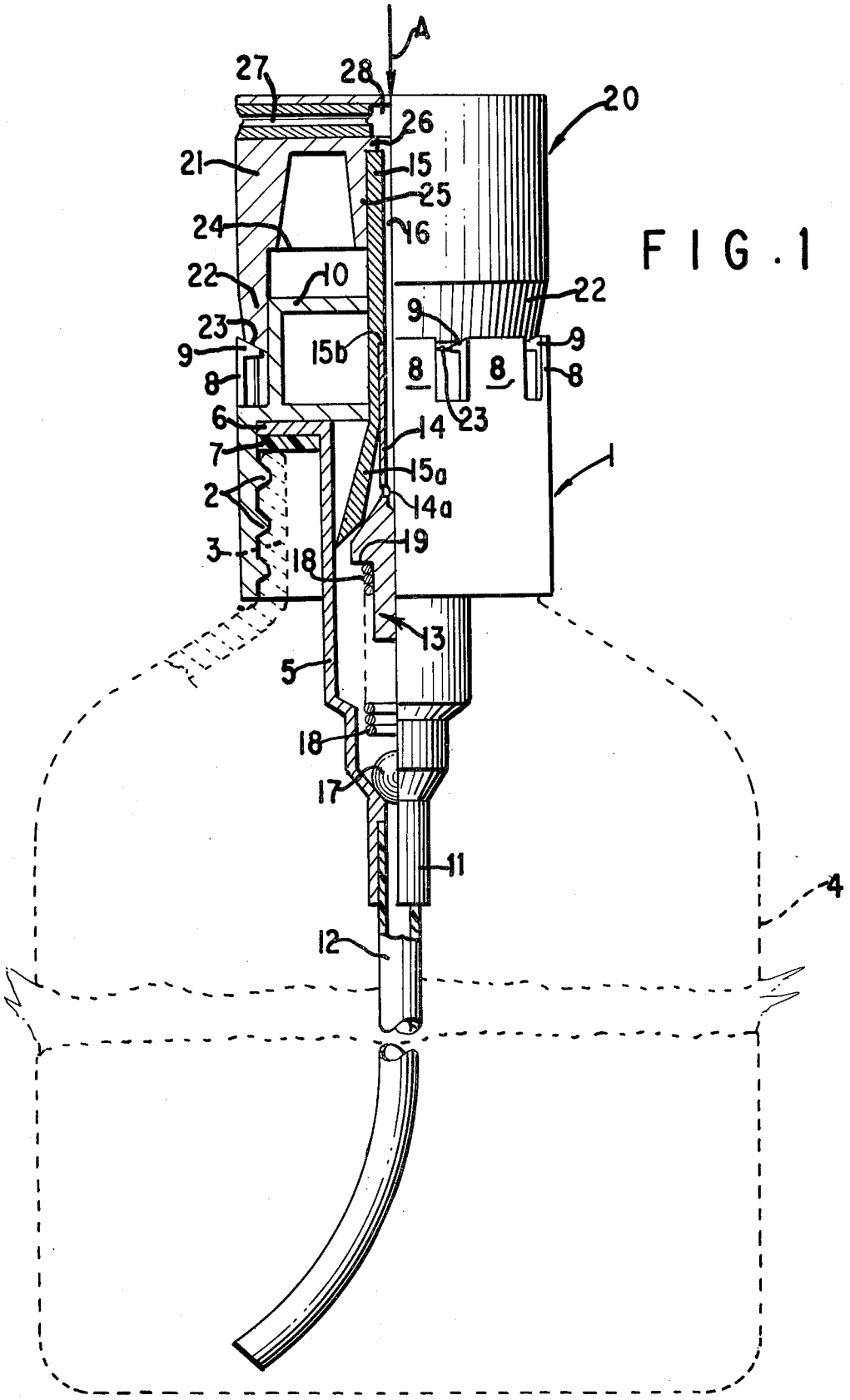

This is a continuation-in-part of copending application Ser. No. 711,318, filed Aug. 3, 1976, now abandoned which in turn is a continuation of application Ser. No. 522,228, filed Nov. 8, 1974, now abandoned.

This invention relates to a novel and improved manually actuated liquid-atomizing pump assembly for non-pressurized pharmaceutical atomizers, which makes it possible to expel a spray of substantially the same particle size spectrum from the atomizer nozzle with each pump actuation.

BACKGROUND OF THE INVENTION

Certain liquid pharmaceutical spray compositions, such as inhalation sprays, are packaged in and dispensed from non-pressurized containers equipped with a manually actuated pump and an atomizer nozzle. The pump is designed to expel with each actuation thereof a given quantity of atomized liquid from the nozzle. However, the particle size spectrum of the spray issuing from the nozzle is affected by variations in the manual force with which the pump is actuated, especially in the case of spray devices which finely atomize the liquid composition. Since the efficacy of many drugs adapted for spray application depends upon the particle size spectum of the spray, it is of utmost importance that the particle size spectrum of the spray be substantially the same with each actuation of the pump.

OBJECTS OF THE INVENTION

It is an object of the present invention to provide a manually actuated pump assembly for non-pressurized pharmaceutical atomizers which causes a spray of substantially the same particle size spectrum to be discharged from the atomizer nozzle with each actuation of the pump, regardless of the amount of external manual force which is applied to the pump actuator.

Other objects and advantages of the invention will become apparent as the description thereof proceeds.

THE INVENTION

In accordance with the present invention the above object is achieved by providing between the pump actuator unit and the pump unit a resilient mechanical resistance which requires a very definite amount of pressure force to be overcome, this pressure being subsequently also automatically available for transport of the liquid to be atomized to and through the atomizer nozzle. Pursuant to the instant invention, the resilient mechanical resistance is provided by a snap device which, upon being overcome by a predetermined amount of force applied to the pump actuator unit, operates the pump unit in thrust-like fashion.

The snap device consists of a plurality of resilient elements, each comprising a wedge, and an oppositely positioned shoulder which abuts against the wedge in the position of rest. Upon actuation of the pump, that is, when pressure is applied to the manual pump actuator unit and this pressure has reached a certain predetermined amount, the resilient elements bend and the wedges suddenly snap out of the way allowing the pump actuator unit to advance all the way to its stop position, whereby the pump is actuated in thrust-like or jerky manner. Variations in the actuating force on the pump are thereby eliminated, and the full discharge pressure is instantly created at the atomizer nozzle.

The resilient elements comprising the wedges may, for example, be mounted on the pump unit, and the corresponding shoulders may be located on the pump actuator unit. Conversely, the resilient elements comprising the wedges may be mounted on the pump actuator unit, while the corresponding shoulders are positioned on the pump unit.

In principle, it is immaterial whether the resilient elements comprising the wedges are mounted on the pump unit or on the pump actuator unit, provided the shoulders are correspondingly located on the pump actuator unit or on the pump unit, respectively.

Figure 2:
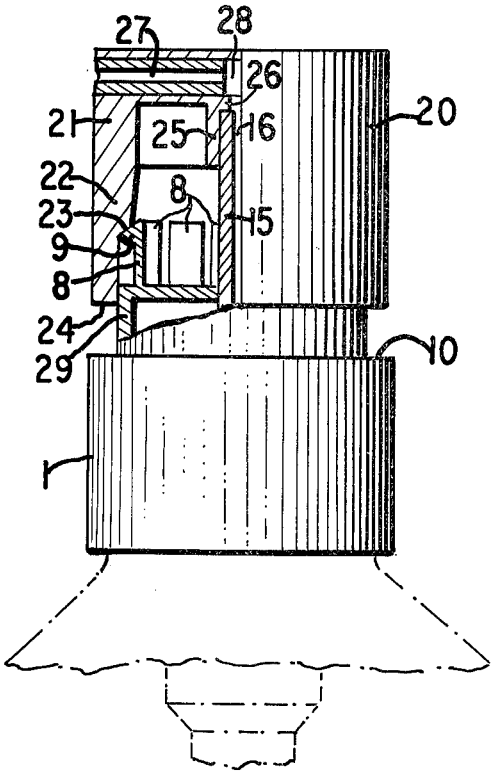
Figure 3:
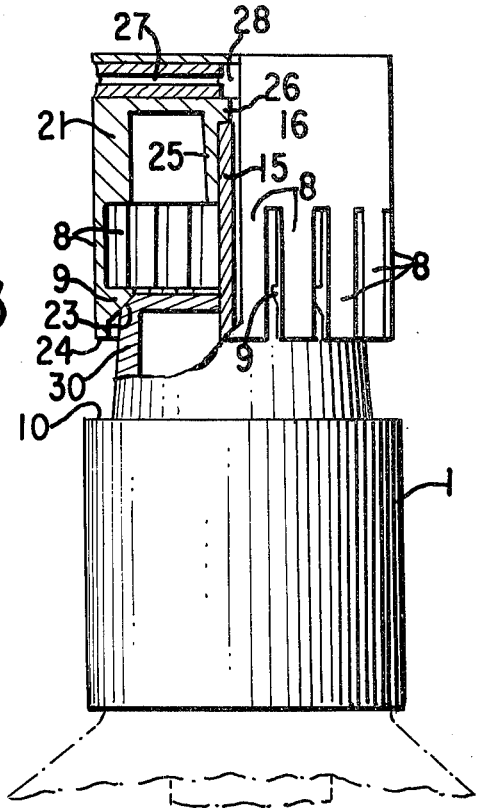

The present invention will be better understood by referring to the attached drawings, where like reference numerals identify like parts, of which FIG. 1 is a side view, in partial vertical section, of an atomizer pump assembly incorporating one embodiment of the snap device according to the present invention;

FIG. 2 is a side view, in partial vertical section, of an atomizer pump assembly incorporating another embodiment of the snap device according to the present invention; and FIG. 3 is a side view, in partial vertical section, of an atomizer pump assembly incorporating still another embodiment of the snap device according to the present invention.

Referring now to FIG. 1, this embodiment of the snap device pursuant to the instant invention is one in which the resilient elements comprising the wedges are attached to the pump unit, while the shoulders are part of the pump actuator unit.

The pump unit consists of a cylindrical cap 1 provided with internal screw threads 2 which engage a correspondingly threaded neck 3 of a non-pressurized container 4 which is filled with the liquid to be atomized. Concentrically mounted within cap 1 is a cylinder 5 which extends below the lower edge of the cap. The lower end of cylinder 5 is stepwisely tapered and terminates in a fitting 11 having a flexible tube 12 inserted therein which extends to the bottom of the container 4. At its upper end cylinder 5 terminates in an annular flange 6 which is provided with a washer 7 to create a tight seal against the neck 3 of container 4. Resilient elements 8 are arranged in spaced relationship in a circle and project upwardly from the outer circumference of cap 1 and terminate in wedges 9 which abut against the side wall of stop 10 mounted on top of cap 1. Slideably mounted within cyclinder 5, cap 1 and stop 10 is a piston assembly consisting of a tubular member 15 which terminates at its lower end in a cone-shaped resilient cuff **15*a* and comprises a shoulder 15*b*, and a plunger 13 having a rigid tubular extension 14 which is seated at its upper end against shoulder 15*b* and has a horizontal aperture 14*a* therein. The slanted lower end of cuff 15*a* forms a seal between cylinder 5 and plunger 13. Tubular member 15 and tubular extension 14 form a vertical channel 16 which extends from the top of plunger 13 just below aperture 14*a* upwardly to the upper end of tubular member 15. Except for aperture 14*a*, channel 16 is closed at the bottom, but open at the top. A ball valve 17 is provided in the lower portion of cylinder 5, and a spring 18 is inserted between ball valve 17 and shoulder 19 of plunger 13. The lower end of spring 18 does not touch ball 17**, however.

The pump actuator unit consists of cover 20 which is slideably mounted over stop 10. Side wall 21 of cover 20 terminates at its lower edge in a tapered section 22 comprising a slanted shoulder 23 which is seated against wedges 9. Within the interior of cover 20 side wall 21 thickens to form shoulder 24, and a tubular fitting 25 having a shoulder 26 is provided into which the upper end of tubular member 15 is inserted. Cover 20 further comprises atomizer nozzle 27 which communicates with channel 16 and aperture 14*a* by way of chamber 28.

The device operates as follows: Pressure is applied on cover 20 — with a finger, for example — in the direction of arrow A. Shoulder 23 transmits this pressure to wedges 9. As the pressure on cover 20 is increased, resilient elements 8 bend outwardly until wedges 9 snap out from beneath slanted shoulder 23. At this time cover 20 becomes suddenly free to slide downwardly in thrust-like, jerky fashion until shoulder 24 touches stop 10. The thrust-like downward motion of cover 20 is transmitted to the piston assembly through shoulder 26. The space defined by chamber 28, vertical channel 16, horizontal aperture 14*a* and the interior of cylinder 5 between cuff 15*a* and ball valve 17 is already occupied by liquid to be atomized from previous pump actuations. As tubular member 15, cuff 15*a*, extension 14, plunger 13 and spring 18 are pushed downward, the lower end of spring 18 comes in contact with and pushes against ball valve 17, thereby closing it. The liquid in said space being a non-compressible fluid, the pressure exerted upon it is transmitted to resilient cone-shaped cuff 15*a* which now bulges outwardly, thereby moving out of contact with plunger 13, opening a channel between it and plunger 13 and allowing the liquid to flow through aperture 14*a* into channel 16. The column of liquid already present in channel 16 is expelled in thrust-like manner through nozzle 27, whereby it is atomized into a spray having a substantially uniform particle size spectrum. After release of the pressure upon cover 20 the tension in compressed spring 18 returns the components of the piston assembly and cover 20 to their original position, which at the same time disengages spring 18 from ball valve 17 thereby freeing it, and allows liquid from container 4 to be aspirated through ball valve 17 into the space in the interior of cylnder 5 between cuff 15*a* and ball valve 17. Resilient elements 8 also simultaneously snap back into their upright position beneath shoulder 23 on cover 20, and the device is ready for the next actuation.

FIG. 2 shows an embodiment of the snap device pursuant to the present invention in which the resilient elements comprising the wedges are also attached to the pump unit, but in the interior instead of around the outer circumference of cap 1.

Thus, in this embodiment the pump unit comprises an internally threaded cap 1 having an external shoulder or stop 10, and an inwardly recessed, upwardly projecting cylindrical extension 29 from which resilient elements 8 extend upwardly and terminate in wedges 9. The structure of the other elements of the pump unit is the same as in FIG. 1.

The pump actuator unit in this embodiment consists of a cover 20 which is slidably mounted over extension 29. Side wall 21 of cover 20 narrows into a tapered section 22 comprising slanted shoulder 23 which is seated against wedges 9. At its lower end side wall 21 terminates in a shoulder 24. Within the interior of cove 20 a tubular fitting 25 having a shoulder 26 is provided into which the upper end of tubular member 15 of the pump unit is inerted. As in the embodiment of FIG. 1, cover 20 also further comprises atomizer nozzle 27 which communicates with channel 16 through chamber 28.

The embodiment shown in FIG. 2 operates on the same principle as that shown in FIG. 1, except that as the pressure on cover 20 is increased, resilient elements 8 bend inwardly until wedges 9 snap out from beneath slanted shoulders 23, at which time cove 20 becomes suddenly free to slide downwardy in thrust-like fashion until shoulder 24 touches top 10.

FIG. 3 shows a further embodiment of the snap device pursuant to the present invention in which the resilient elements comprising the wedges are attached to the pump actuator unit instead of to the pump unit.

Thus, in this embodiment the pump unit comprises an internally threaded cap 1 having an external shoulder or stop 10, and an inwardly recessed, slightly conical upwardly projecting extension 30 having a slanted shoulder 23. The structure of the other elements of the pump unit is the same as in FIG. 1.

The pump actuator unit comprises a cover 20 having a side wall 21. Resilient elements 8 are arranged in spaced relationship in a circle and project downwardly from the outer circumference of side wall 21 and comprise wedges 9 which abut against shoulder 23, terminating in shoulders 24. Within the interior of cover 20 a tubular fitting 25 having a shoulder 26 is provided into which the upper end of tubular member 15 is inserted. Cover 20 further comprises atomizer nozzle 27 which communicates with channel 16 by way of chamber 28.

The embodiment of FIG. 3 operates on the same basic principle as those shown in FIGS. 1 and 2, except that as the pressure on cover 20 is increased, resilient elements 8 bend outwardly until wedges 9 snap away from shoulder 23, at which time cover 20 is suddenly freed to slide downwardly in thrust-like fashion over extension 30 of cap 1 until shoulders 24 touch stop 10.

In each of the embodiments shown in FIGS. 1, 2 and 3, the pressure on cover 20 under which wedges 9 snap away from shoulders 23 can be decreased or increased to any desired pre-determined value by increasing or decreasing the resiliency of elements 8, for instance by varying the thickness thereof or the nature of the material of which they are made.

The structure of the pump assembly shown in FIG. 1 is merely illustrative of the type of manually operated atomizer pump in conjunction with which the snap device of the present invention can be used; the snap device is operative in conjunction with any other manually actuated pump assembly which works on the same general mechanical principle as that illustrated in FIG. 1.

While the present invention has been illustrated with the aid of certain specific embodiments thereof, it will be readily apparent to others skilled in the art that the invention is not limited to these particular embodiments, and that various changes and modifications may be made without departing from the spirit of the invention or the scope of the appended claims.

We claim:

1. A manually operated liquid-atomizing pump assembly for a non-pressurized, liquid-filled container consisting of a pump unit comprising a screw cap and a pump, a pump actuator unit connected to said pump and comprising an atomizing nozzle, said pump actuator unit concentrically slidably mounted over said pump unit and adapted to actuate said pump and expel a spray of atomized liquid from said nozzle upon manual actuation of said pump actuator unit, and a snap device interposed between said screw cap and said pump actuator unit and adapted to snap upon application of a predetermined amount of force to said pump actuator unit, said snap device consisting of a plurality of resilient blades each having a fixed end and a free end, a laterally extending wedge extension attached to the free end of each of said resilient blades, fixed ends of said blades being attached to one of said screw cap and said pump actuator unit, said resilient blades being arranged substantially vertically in a concentric circle about the common sliding axis of said screw cap and said pump actuator unit, and an opposing annular rigid shoulder attached to the other of said screw cap and said pump actuator unit and providing a surface against which said wedge extensions abut.

2. The device of claim 1, wherein the fixed ends of said resilient blades are attached to said screw cap and said shoulder is attached to said pump actuator unit.

3. The device of claim 1, wherein the fixed ends of said resilient blades are attached to said pump actuator unit and said shoulder is attached to said screw cap.

* * * * *